US005725411A

United States Patent [19]

Glynn

[11] Patent Number: 5,725,411

[45] Date of Patent: Mar. 10, 1998

[54] CONSTRUCTION BEAM BLOCK TOY WITH SELECTIVE ANGULAR INTERLOCK

[75] Inventor: Kenneth P. Glynn, Raritan Township, N.J.

[73] Assignee: Ideal Ideas, Inc., Flemington, N.J.

[21] Appl. No.: 218,158

[22] Filed: Mar. 25, 1994

[51] Int. Cl.[6] ..... A63H 33/08

[52] U.S. Cl. ..... 446/128; 446/124; 403/4

[58] Field of Search ..... 446/85, 117, 120–122, 446/124, 128, 125; 403/3, 4; D21/108; 273/160, 276; 434/259

[56] References Cited

U.S. PATENT DOCUMENTS

| | | | |
|---|---|---|---|
| Re. 33,785 | 12/1991 | Hildebrandt et al. | 446/126 |
| D. 51,552 | 12/1917 | Gilbert | D21/108 |
| D. 259,762 | 7/1981 | Sabin | D21/108 |
| D. 307,774 | 5/1990 | Bertrand | D21/108 |
| 1,422,146 | 7/1922 | Tackenberg | 446/128 |
| 1,608,592 | 11/1926 | Funk | 446/126 |
| 1,718,230 | 6/1929 | Graves | 446/126 |
| 3,162,973 | 12/1964 | Christiansen | 446/128 |
| 3,199,246 | 8/1965 | Fischer | D21/108 |
| 3,233,358 | 2/1966 | Dehm | 446/128 |
| 3,487,579 | 1/1970 | Brettingen | 446/128 |
| 3,605,322 | 9/1971 | Matsubayashi | 446/128 |
| 3,867,784 | 2/1975 | Lange | 446/128 |
| 4,078,328 | 3/1978 | Rayment . | |
| 4,129,975 | 12/1978 | Gabriel | 52/648 |
| 4,571,200 | 2/1986 | Serna | 446/85 |
| 4,609,356 | 9/1986 | Gilden | 434/259 |
| 4,631,040 | 12/1986 | Shiraishi | 446/124 |
| 4,731,041 | 3/1988 | Ziegler | 446/115 |
| 4,764,144 | 8/1988 | Lyman | 446/128 |
| 4,964,833 | 10/1990 | Suzuki | 446/128 |
| 5,022,885 | 6/1991 | Lyman | 446/95 |
| 5,137,485 | 8/1992 | Penner | 446/111 |
| 5,137,486 | 8/1992 | Glickman | 446/126 |
| 5,238,438 | 8/1993 | Glickman | 446/126 |

FOREIGN PATENT DOCUMENTS

| | | | |
|---|---|---|---|
| 1150976 | 1/1958 | France | 446/128 |
| 184497 | 1/1956 | Germany . | |

*Primary Examiner*—Robert A. Hafer
*Assistant Examiner*—Jeffrey D. Carlson
*Attorney, Agent, or Firm*—Kenneth P. Glynn, Esq

[57] ABSTRACT

The present invention is directed to a novel construction toy having a main block body adapted to be removably engaged with other block bodies and connection elements or beam members. The block body provides recessed or protruding octa-arc connectors, as well as, additional connectors that mate with the ends of the connection elements and beam members to form composite structures. The octa-arc connector is comprised of a recessed surface area circumscribed by an outer circular perimeter of eight arcs symmetrically arranged in a generally circular manner and an inner perimeter which may be circular or eight arcs symmetrically arranged in a generally circular manner.

22 Claims, 11 Drawing Sheets

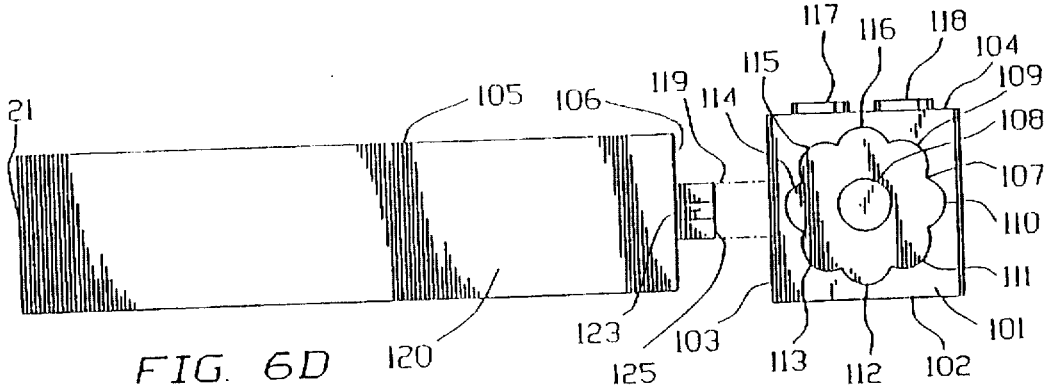
FIG. 6D
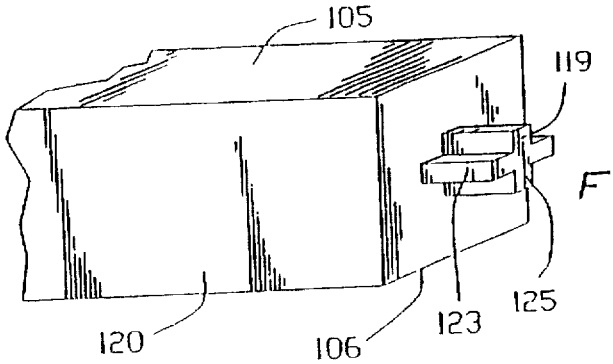
FIG. 6E
FIG. 6F
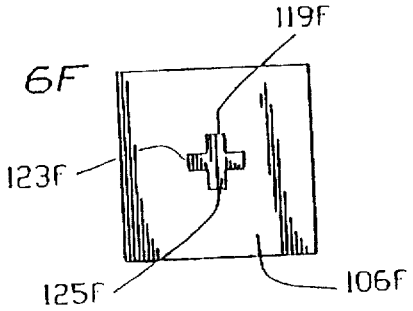
FIG. 6G
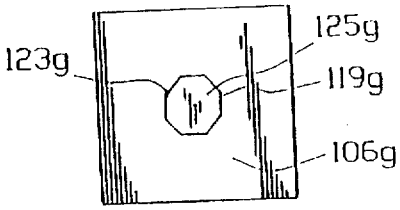
FIG. 6H
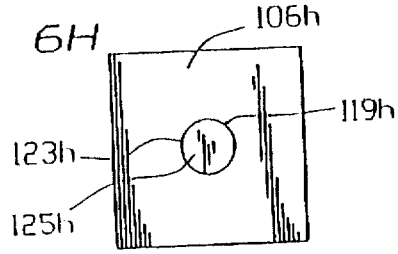

FIG. 16A
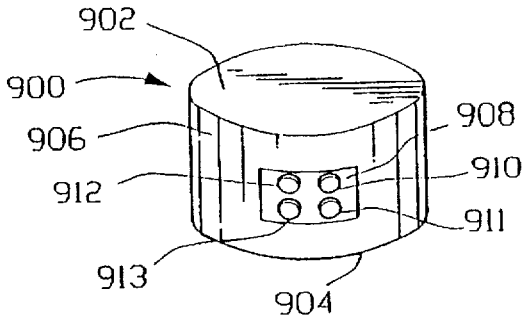
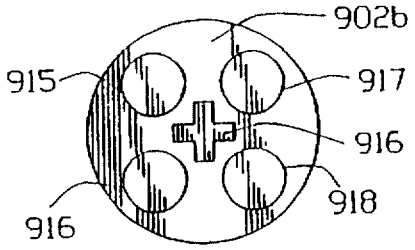
FIG. 16B
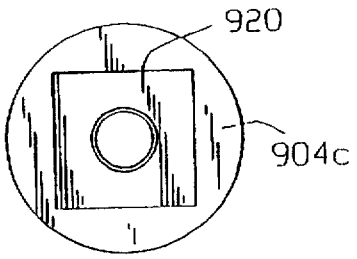
FIG. 16C
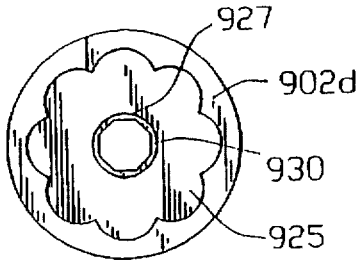
FIG. 16D
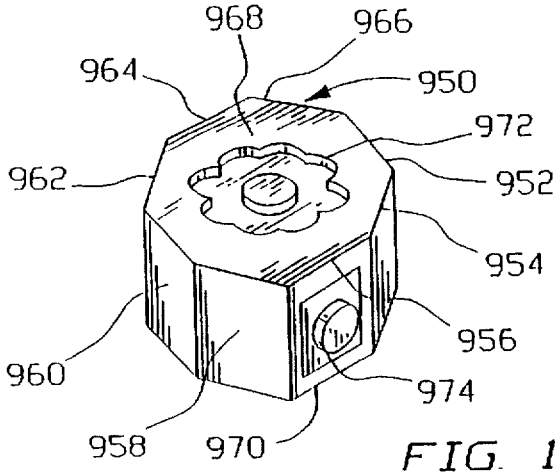
FIG. 17

CONSTRUCTION BEAM BLOCK TOY WITH SELECTIVE ANGULAR INTERLOCK

BACKGROUND OF THE INVENTION

1. Field of the Invention

The present invention is directed to a novel construction beam-interlocking block toy having a main block body adapted to be removably engaged with other block bodies, some of the embodiments including construction beams attached thereto to form a composite structure. The block body provides attachment means in the shape of octa-arcs that can be either recessed or protruding to allow other blocks and construction beams to attach to the block body at eight different angles so that elaborate 3-D bridges, buildings, robots, cranes, towers, and other such structures, can be formed.

2. Prior Art Statement

Various types of toy construction blocks and related toys have been designed. The following represents the state of the art:

U.S. Pat. No. 4,078,328 to Rayment describes a construction toy set with a connector unit or spider having a central disk-shaped portion with a plurality of arms extending radially therefrom with each arm having a bulbous portion formed at the end, thereof.

U.S. Pat. No. 4,129,975 to Gabriel describes a construction set comprised of a plurality of hollow 26 faceted joint elements with the facets being arranged in a selected orientation and having an opening located in each facet for receiving an elongated strut for interconnecting a plurality of the joint elements.

U.S. Pat. No. 4,731,041 to Ziegler describes polygonal construction modules capable of being connected together by their edges and faces, each edge face having a plurality of outwardly projecting-fingers to provide a snap-together lateral interlock between fingers of adjacent modules.

U.S. Pat. No. 5,022,885 to Lyman describes a construction toy formed from a plurality of building blocks, each block formed with a multiplicity of facets defining an exterior having structure for attachment to another facet, whereby the attachment means are radially extending spokes, vanes, and other complementary formed recesses disposed on top and bottom walls.

U.S. Pat. No. 5,137,486 to Glickman describes a construction set comprising main strut members, auxiliary strut members, articulated strut members, an in-line connector member, a panel member and a wheel member, whereby all members, except the panel member, form identical connection joints with one another anywhere on multiple sides of the components.

U.S. Pat. No. 5,137,485 to Penner describes connecting elements for a construction toy designed such that an assembly of two such connector elements provides for connection in each of two planes oriented at right angles to each other.

U.S. Pat. No. 5,238,438 to Glickman describes a construction toy including a hub-like connector having one or more gripping sockets, and structural elements to be received in the gripping sockets.

None of the prior art, however, discloses a combination construction beam-interlocking block toy comprising a -block body with octa-arc connectors and additional connectors, the block body optionally having construction beams and other block bodies attached thereto at angles of 0 to 315 degrees in 45 degree increments.

SUMMARY OF THE INVENTION

The present invention comprises a construction beam-interlocking block toy having at least one block body and, optionally, at least one construction beam which interconnect with one another, in either a releasable or permanent fashion, to form a composite structure. The block body provides primary recessed attachment means in the shape of an octa-arc. However, it could additionally comprise secondary protruding attachment means in the octa-arc shape which would insert into a facet of a block having a mating recessed or female octa-arc shape. The octa-arc feature is generally circular, made up of arcs of eight symmetrically arranged, overlapping circles. This unique feature allows for attachment of other block bodies, construction blocks that are well known in the toy art, such as those sold under the registered trademark LEGO, and a variety of construction beams, at angles of 0 to 315 degrees in 45 degree increments. In addition, the block bodies of the present invention may include additional connectors comprising protrusions or recesses arranged in a predetermined pattern.

BRIEF DESCRIPTION OF THE DRAWINGS

The present invention is more fully understood when the instant specification is taken in conjunction with the drawings which are appended hereto, wherein:

FIG. 6*d* shows an exploded side view of the construction beam-interlocking block body of FIG. 6*a;*

FIG. 6*e* shows a rotated view of the construction beam of FIG. 6*d;*

FIGS. 6*f*, 6*g*, 6*h* show end views of the construction beam of FIGS. 6*a*, 6*d*, 6*e* with various connector shapes;

FIG. 16*a* shows a schematic of a cylindrical block body having means for connection;

FIGS. 16*b* and 16*d* show top views of the block body of FIG. 16*a* having various types of connectors;

FIG. 16*c* shows a bottom of the block body of FIG. 16*a*; and,

FIG. 17 shows a schematic of an octagonal block body with various means for connection.

DETAILED DESCRIPTION OF THE INVENTION

Figure 1:
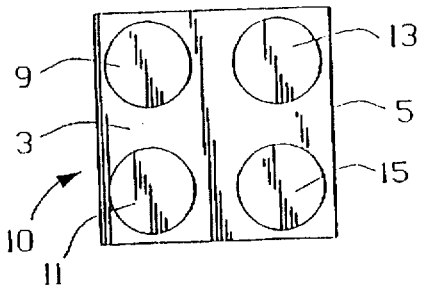
FIG. 1 (PRIOR ART)
FIG. 1 shows a Prior Art block body drawn to scale.
Figure 2:
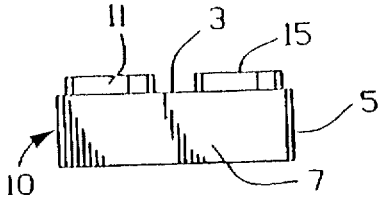
FIG. 2 (PRIOR ART)
FIG. 2 shows a side view of the Prior Art block body.

The present invention is directed to a novel construction beam-interlocking block toy having a main block body adapted to be removably engaged with other block bodies and connection elements. The invention is unique in that it allows the user to construct elaborate composite structures using, not only the block bodies and connection elements of the present invention, but also other well known construction block toys, such as those sold under the registered trademark LEGO, as shown in FIGS. 1 and 2. The prior art interlocking block toy has a block body 10 with a plurality of interlocking, protruding connectors 9, 11, 13, 15 on a top facet 3 which are configured in a specified rectangular pattern to allow for connection to other of the same types of block bodies. One problem with these prior art toy construction blocks are that they do not allow for construction of larger, more complicated structures, since they are limited in terms of the number of sides which have connectors thereon, as seen in FIG. 2, wherein side facets 5 and 7 are not provided with connection means. In addition, the blocks of the prior art are limited in terms of the angle at which other elements can connect due to the arrangement of the connector means. Thus, the construction beam-interlocking block body of the present invention provides the user with the challenge of being able to construct elaborate, yet sturdy, structures by utilizing its unique octa-arc connector.

Figure 3:
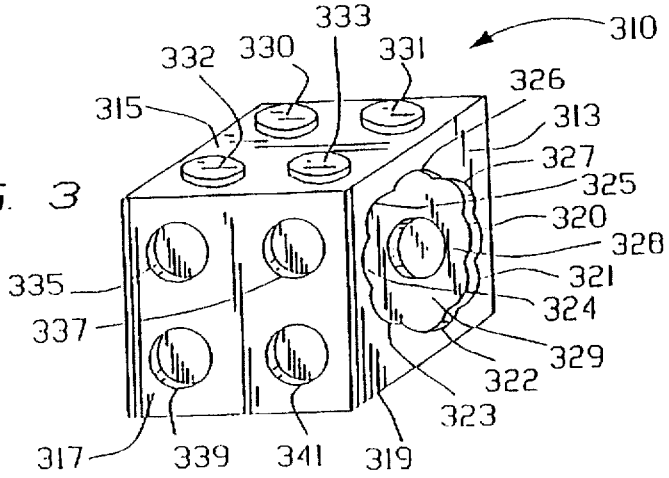
FIG. 3 shows the interlocking block body of the present invention with an octa-arc connector and additional connectors.

The first embodiment of the present invention, as shown in FIG. 3, is a block body 310 having at least five facets, four of which 313, 315, 317, 319 are shown, with at least one of the facets 313 having an octa-arc connector 329. The unique octa-arc connector 329 is comprised of a recessed surface area circumscribed by an outer perimeter of arcs 320, 321, 322, 323, 324, 325, 326, 327 of eight symmetrically arranged, overlapping circles and an inner perimeter 328 with a circular configuration. This arrangement is more clearly described using FIGS. 4–8. In addition, the block body 310 of the present invention may have additional connectors 330, 331, 332, 333 and 335, 337, 339, 341 on several facets 315 and 317, respectively; the additional connectors comprising a group of protrusions or recesses arranged in a predetermined configuration and made to interconnect with other well known block bodies, such as those shown in FIGS. 1 and 2.

Figure 4:
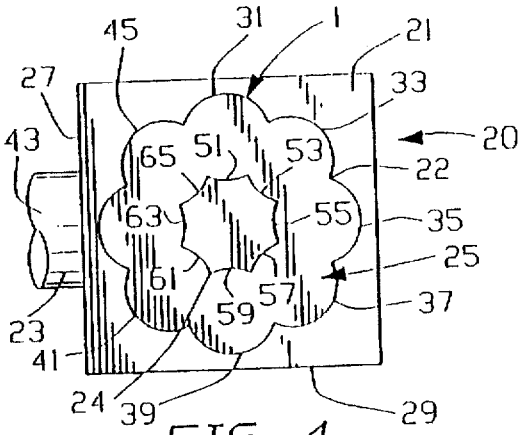
FIG. 4 shows one facet of the block body with the octa-arc connector, drawn to scale to accommodate the connector of the Prior Art block body.

FIG. 4 shows one configuration of the octa-arc connector 1 on one facet 21 of the block body 20, comprised of arcs of eight symmetrically arranged, overlapping circles. The connector has a recessed surface area 25 circumscribed by an outer perimeter 22 of arcs 31, 33, 35, 37, 39, 41, 43 and 45 of eight symmetrically arranged, overlapping circles configured in a generally circular orientation and an inner perimeter 24 of arcs 51, 53, 55, 57, 59, 61, 63 and 65 of eight symmetrically arranged, overlapping circles configured in a generally circular orientation. The block body shown has a facet 29, indicated but not shown, and a facet 27 with a construction beam 23 connected thereto. As shown, the octa-arc connector 1 may be built larger than that of the prior art block such that the octa-arc connector fully accommodates the arrangement of the connectors 9, 11, 13, 15 of the prior art block body 10 (FIGS. 1 and 2). For example, the four protrusions 9, 11, 13 and 15 of the connecting means of the prior art block can be inserted against the recessed surface area 25 and pinched between opposing outer octa-arcs and inner octa-arcs 33 and 53, 37 and 57, 45 and 65 and 41 and 61, respectively. Thus, the four protrusions of the connector means 9, 11, 13, 15 of the prior art blocks can easily, and securely, be inserted against the recessed surface area circumscribed by the outer perimeter and inner perimeter of arcs and pinched by the outer and inner perimeter of arcs at eight different angles, 45 degree increments apart, or into a bottom surface 319 (FIG. 3) of the block body 310 (FIG. 3) as later described, or even into the additional recessed connectors 335, 337, 339 and 341 of side facet 317 (FIG. 3). Additionally, the embodiment of FIG. 4 shows a connection element 23 attached to a second facet 27 of the block body, in a manner also described later herein.

Figure 5:
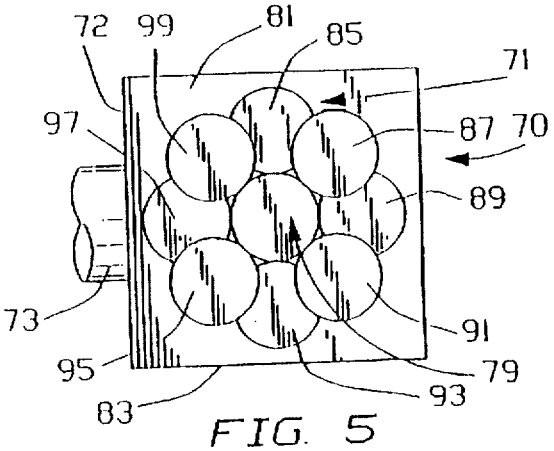
FIG. 5 shows one facet of the block body with a second variation of the octa-arc connector of the present invention.

The octa-arc connector, as shown in FIG. 5, includes a block body 70 having a connector 71 on one facet 81, whereby alternating circles 85, 89, 93, 97 of the octa-arc 71 are inset from circles 87, 91, 95, 99. Unlike the configuration of FIG. 4, the inner perimeter of this configuration does not have a perimeter of arcs, but rather is comprised of an additional circle 79, which may be either inset or protruding. Similar to FIG. 4, this embodiment also shows a construction beam 73 attached to the block body 70 along one facet 72. Another facet 83, indicated but not shown, may have an octa-arc connector like 71 or be configured similar to facet 315 in FIG. 3.

Figure 6A:
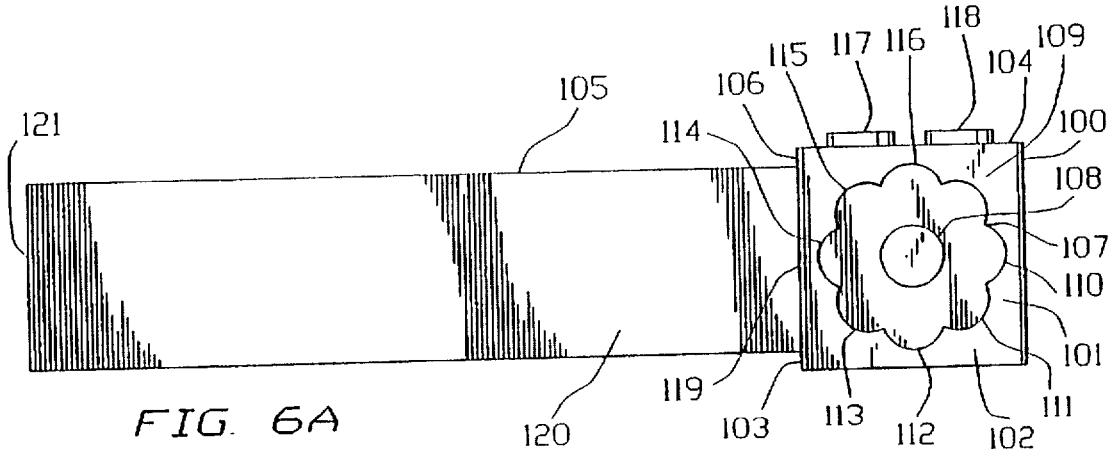
FIG. 6*a* shows a side view of an embodiment of the construction beam-interlocking block body.
Figure 6B:
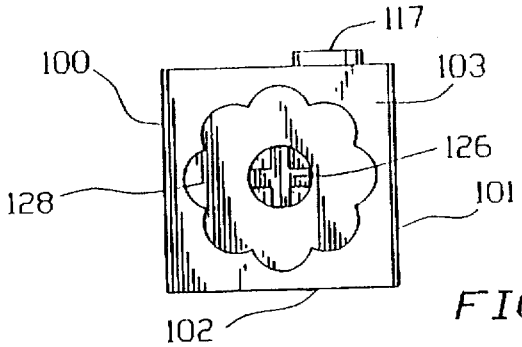
FIG. 6*b* shows a plane view of the side facet of the block body of FIG. 6*a* that connects to the end of the construction beam member of FIG. 6*a;*

Another embodiment of the present invention is shown in FIG. 6*a*. In this embodiment, block body 100 is connected to one end 106 and opposite end 121 of construction beam 105 along a side facet 103. The block body 100 has five facets, three of which are shown 101, 103, 104, and a bottom surface 102. Various connection means are located on three of the facets 101, 103, 104 including an octa-arc connector 107 having an outer perimeter 109, 110, 111, 112, 113, 114, 115, 116 with an inner circular perimeter 108 on facet 101, and at least two protrusions 117, 118 on facet,104. As shown in FIG. 6*a*, facet 101 of the block body is parallel to side 120 of the construction beam 105. Facet 103 of block body 100 as shown FIG. 6*b* has an octa-arc connector 128 as described above, in addition to recessed connection means 126 seated within the center of the octa-arc connector 128. This recessed connection means 126 mates with the protruding connection means 119 of construction beam 105 so as to provide an interlocking connection between the two members (see also FIG. 6D). The recessed connection means 126 of the block body is shaped in a cross formation, however, can be shaped in a variety of forms to accommodate the protruding connection means 119 of the construction beam 105.

Figure 6C:
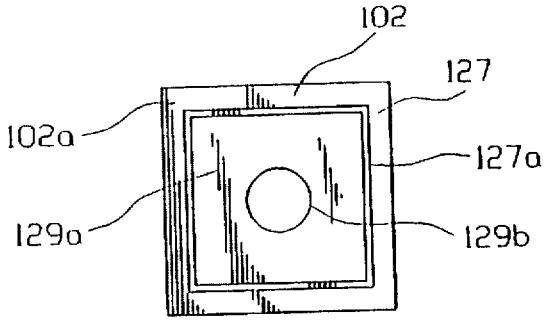
FIG. 6*c* shows a plane view of the bottom of the block body of FIG. 6*a;*

FIG. 6c is a view of the bottom surface 102 of the block body 100. This surface is configured in such a manner as to allow the connection means of the prior art block body, such as that shown in FIGS. 1 and 2, to securely snap into this surface. A solid lip portion 127 is located around the inner edges 102a of the bottom surface 102. The remaining portion of the bottom surface is recessed 129a to a predetermined depth with a hollow cylindrical wall 129b extending to the predetermined depth and being located in a central portion of the hollow bottom surface 129a. This arrangement allows for connection means, such as the four circular protrusions 9, 11, 13, 15 of block body 10, to be pinched between the inner edge 127a of the lip portion 127 and the wall of the Hollow cylinder 129b in an interlocking fashion. This arrangement could also accommodate the additional connectors 330, 331, 332, 333 of a separate block body 310, such as that of FIG. 3.

FIG. 6d is an exploded side view of the invention of FIG. 6a showing the protruding connector means 119 of the construction beam 105. The protruding connector means, shown here, as well as in FIG. 6e, is in the shape of a cross 125 and has a predetermined length 123 for mating with the recessed connection means 126 of the block body 100 as described in FIG. 6b.

FIGS. 6f, 6g and 6h, show views 106f, 106g, 106h, respectively, of the end 106 of construction beam 105 with protruding connection means 119f, 119g, 119h, respectively. The connection means 119 can be in the shape of a cross 125f as described above in FIGS. 6d and 6e, or have a variety of other shapes such as the octagon 125g shown in FIG. 6g or the circle 125h shown in FIG. 6h. Each connection means has a predetermined length 123f, 123g, 123h, respectively. Although, these figures reveal mating connection means between the block body and the construction beam 105, the block body and construction beam could be integrally formed.

Figure 7:
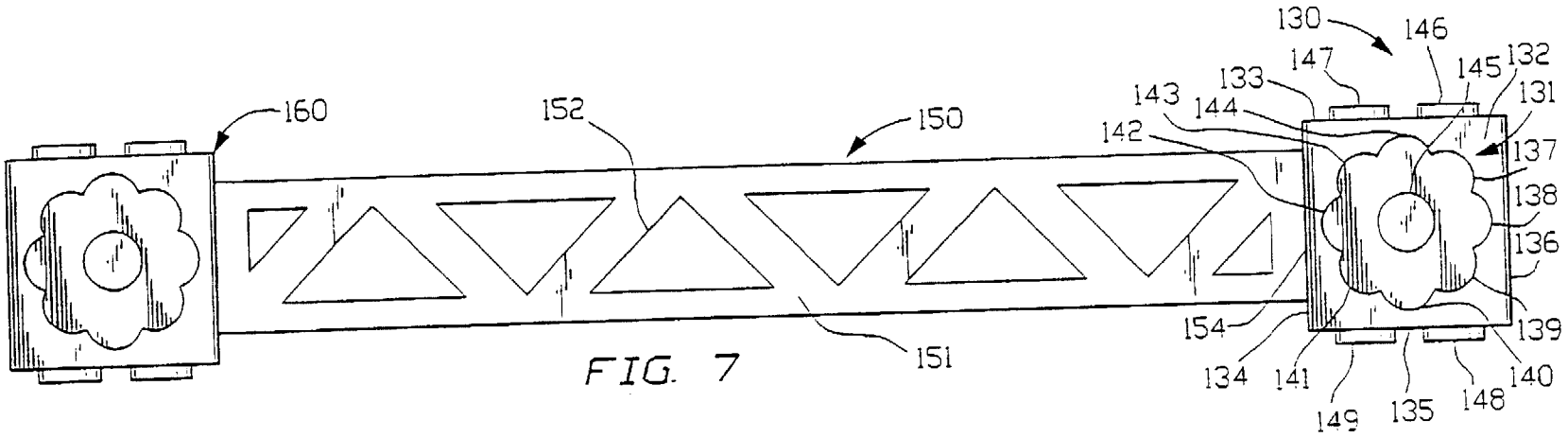
FIG. 7 shows a side view of another embodiment of the present invention.
Figure 11A:
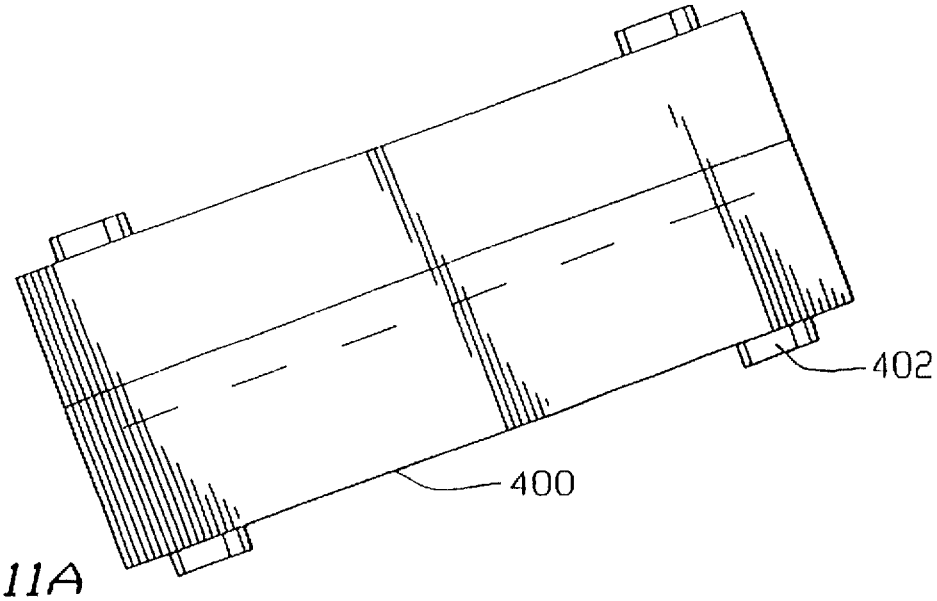
FIG. 11*a* shows a plane view of one type of construction beam of the present invention.
Figure 11B:
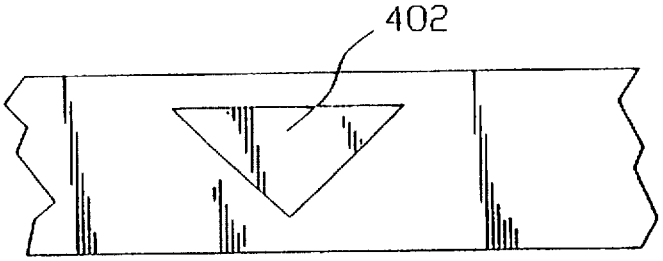
FIG. 11*b* shows an exploded side view of the construction beam of FIG. 11*a;*

The preferred embodiment of the present invention is shown in FIG. 7. In this embodiment, a pair of block bodies 130 and 160 are attached to construction beam 150 along one facet of each block body. As block bodies 130 and 160 are similar, only the first of these block bodies 130 will herein be described. It is preferred that the octa-arc connector 131 is at least on a facet 132 of the block body 130 parallel to the construction beam side 151, or on a facet 136 parallel to the construction beam end 154. As seen in this figure, the octa-arc connector 131 is shown on a facet 132 parallel to the side 151 of the construction beam 150 with facet 134 of the block body 130 being connected to construction beam end 154. The octa-arc connector 131 has only an outer octa-arc configuration since the eight connected arc elements 137, 138, 139, 140, 141, 142, 143, 144 are only along the outer radius or perimeter of the connector 131, while the inner radius or perimeter 145 is comprised of one circle, free of a set of eight connected arc elements. In addition, the block body 130 may have protruding connectors 146, 147 and 148, 149 on several of the other facets 133 and 135, respectively. Although this side view reveals only two connectors 146, 147 and 148, 149 respectively on each facet 133, 135, the number and configuration of the connectors on each facet may vary (FIGS. 3, 14a–c and 15a–b). The construction beam 150, has cut-outs 152 along the side 151 of the structure for allowing other connection elements to attach therealong. Other construction beams could have on their sides multiple protrusions which are configured similarly to the cut-outs to allow the protrusions to be inserted into the cut-outs and be pinched by the perimeter of the cut-outs. (see FIGS. 11A and B, 12A, B and C). Any one of the protrusions could mate or connect with any one of the cutouts, thus permitting several construction beams to be connected in various positions relative to one another. Although not shown, the octa-arc connector of the present invention could have an inner octa-arc surface configuration only, such as the inner surface 24 of FIG. 4, and could be either recessed or protruding.

Figure 9:
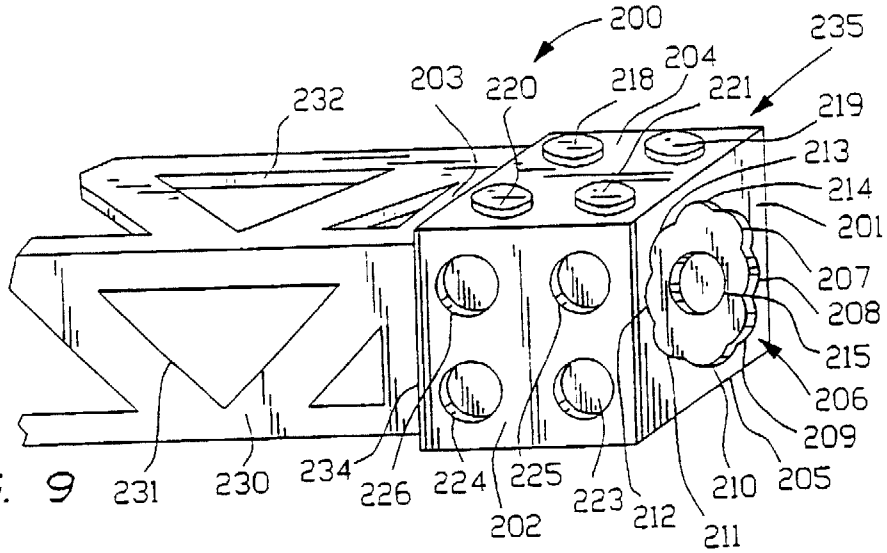
FIG. 9 shows a three-dimensional schematic of one embodiment of the block body of the present invention with various types of connector means.

FIG. 9 shows a three-dimensional schematic 200 of one end of the embodiment of the present invention including a block body 235 attached to a connection element 230 along one of its facets 203. The block body 235, as shown, reveals three facets 201, 202, 204 with an octa-arc connector 206 on one facet 201 and protruding 218, 219, 220, 221 and recessed 223, 224, 225, 226 additional connector means on second 204 and third facets 202, respectively. A fourth facet 205, not shown but indicated, may be configured similarly to facet 201, 202 or 204. The octa-arc connector 206 and the additional connector means 218, 219, 220, 221 and 223, 224, 225, 226 may be on any of the facets. In FIG. 9, the octa-arc connector 206 is on at least the facet of the block body 235 that is parallel to the end 234 of the construction beam 230; and is comprised of eight connected arcs 207, 208, 209, 210, 211, 212, 213, 214 along the outer surface, while the inner surface is smooth or circular 215. As described above, the construction beam 230 may have cut-outs 231, 232 in its surfaces for attachment with other construction beams.

Figure 8:
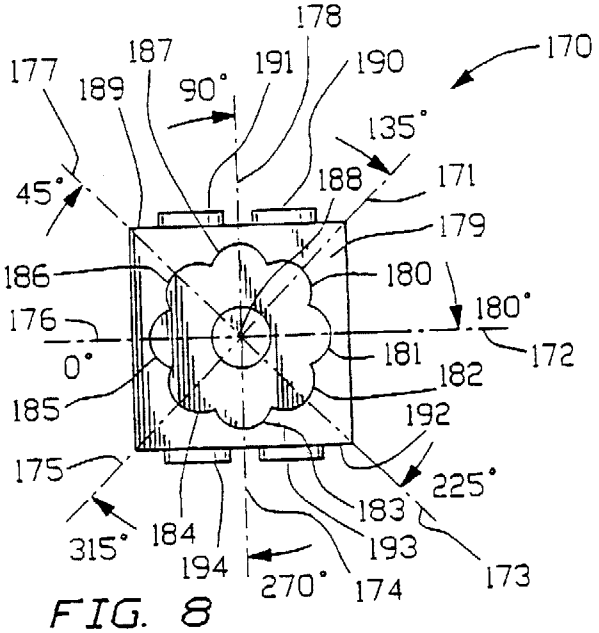
FIG. 8 shows the technical angle arrangement of the octa-arc connector of the present invention.

Due to the novel configurations of the octa-arc connectors described above, elements, which include rods, beams, panels and the like, that have mating edges or ends, may interconnect to the block body at angles of 0 to 315 degrees at 45 degree increments, as shown in FIG. 8. FIG. 8 is a technical representation of the geometry of the block body 170, whereby one facet 179 has an octa-arc comprised of an outer perimeter of arcs 180, 181, 182, 183, 184, 185, 186, 187, an inner circular perimeter with center at 188 and other facets 189, 192 have additional connectors 190, 191 and 193, 194, respectively, thereon.

Figure 10:
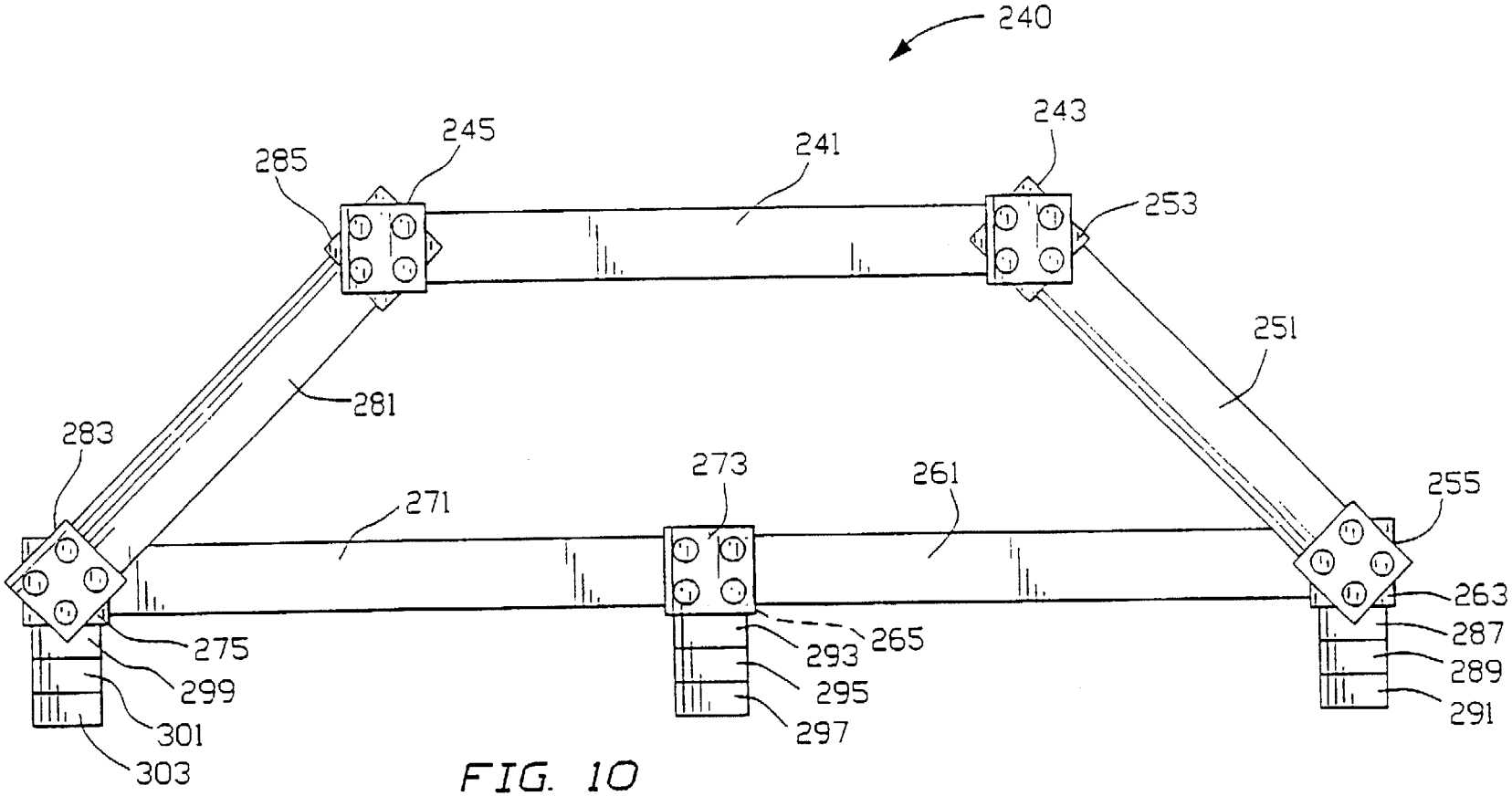
FIG. 10 shows a two-dimensional composite structure built with various components of the present invention.

The octa-arc is formed of the arcs of eight circles arranged in an overlapping, symmetric manner such that a line drawn from the center 188 of the octa-arc connector, bisecting the center of the arc, forms a 45 degree angle with the lines of adjacent arcs. In this manner, line 171 of arc 180 forms a 45 degree angle with line 172 of arc 181 and 178 of arc 187. Likewise, line 173 of arc 182 forms a 45 degree angle with line 172 of arc 181 and line 174 of arc 183. Similarly, the same relationship holds for lines 174, 175, 176, and 177. This arrangement allows two block bodies, including the block body 10 of the prior art, to attach to each other through mating surfaces and mating connectors at varying angles. These unique features allow a user to construct a variety of composite structures, such as the one 240 shown in FIG. 10. FIG. 10 shows a two dimensional view of a composite bridge structure 240 made with a plurality of the construction beam-interlocking block bodies of the present invention, in addition to the block bodies of the prior art as described in FIGS. 1 and 2. In this structure, a group of construction beam-interlocking block body elements, such as that shown in FIG. 7, snap together to form a composite structure. Specifically, the composite bridge structure 240 is comprised of six different interconnected members. The first three members consist of two block bodies and a construction beam, such that member one is comprised of three elements 241, 243, 245; member two is comprised of elements 251, 253, 255; and member three is comprised of elements 281, 283, 285. Members four and five consist of one block body and one construction beam each, such that member four is comprised of the two elements 275, 271; and member five is comprised of elements 261, 263. Member six consists of a single block body 273 having side facets for connecting to elements 261 and 271, in a manner described in FIGS. **6*d*–6*h*. Each of the members one through five is interconnected with at least one other member through octa-arc connectors (not shown) and additional connectors on each block body. In addition, members four, five and six have mating bottom surfaces, as described in FIG. 6*c*, for mating with the predetermined connectors arranged on a top surface of the prior art block bodies shown in FIGS. 1 and 2. Thus, stacked prior art block bodies 299, 301, 303 connect to a bottom surface of block body 275; stacked prior art block bodies 293, 295, 297 connect to a bottom surface 265 of member 273; and stacked prior art block bodies 287, 289, 291 connect to the bottom surface of element 263**.

As can be seen from this embodiment, the octa-arc connector plays a key role in allowing these dumbbell shaped elements to be manipulated at various angles. In this manner, it is important for the block body to provide a combination of various connectors, as described above, on each of its facets to provide means for re-aligning and positioning the elements according to the composite structure desired. In addition, in order to be able to build structures such as that shown in FIG. 10, it is important that the construction beam-interlocking block elements 251 and 261 of the present invention be made in lengths of varying sizes. In particular, when considering structures that require the elements to be put in a triangular fashion at 45 degree angles, the pythagorean theorem would need to be observed in the manufacturing process of the elements to produce a set of matching pieces.

The structure of FIG. **11*a* and 11*b* reveals a panel 400 having means to mate 402 on its side surface with the cut-out connector means 152 of the construction beam 150 of FIG. 7**, in an L-shaped fashion.

FIG. **12*a* shows a side view of a variation on the construction beam-interlocking block body of FIG. 7. The member 410 is shown with two block bodies 412, 414 attached at respective side facets 426, 420, either integrally or in a manner described above in FIGS. 6*d*–6*h*, to connection or construction beam 416. Since the block bodies 412 and 414 are similar, only block body 412 will be further described. The block body, as shown in both FIGS. 12*a* and 12*b* has six facets, with five 422, 424, 426, 428, 430 being shown. Unlike the block body of FIG. 6*a*, the bottom facet 424 of block 412 is not hollow but has at least two protruding connectors 418, 419. In addition, at least two of the facets 422, 430 have octa-arc connectors 436, 438, respectively, thereon; and the top facet 428 has a predetermined arrangement of additional protruding connectors 431, 432, 433, 434. In addition to other block bodies and construction beams being able to interact with the various connectors 436, 438, and 431, 432, 433, 434 of the block body 412, the construction element 416 also provides connector means 446 on the top surface 440 and connector means 444 on the side surface 442. Unlike the triangular cut-out connectors 152 of FIG. 7**, these connectors are circular and allow for the connection of plates.

Figure 12A:
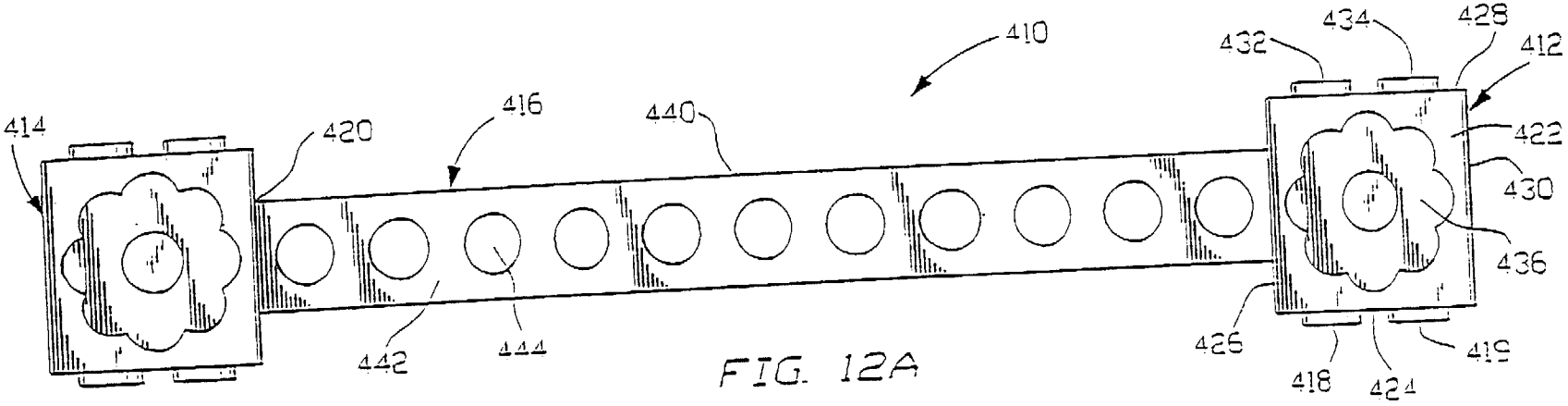
FIG. 12*a* shows a side view of a variation of the embodiment of FIG. 7.
Figure 12B:
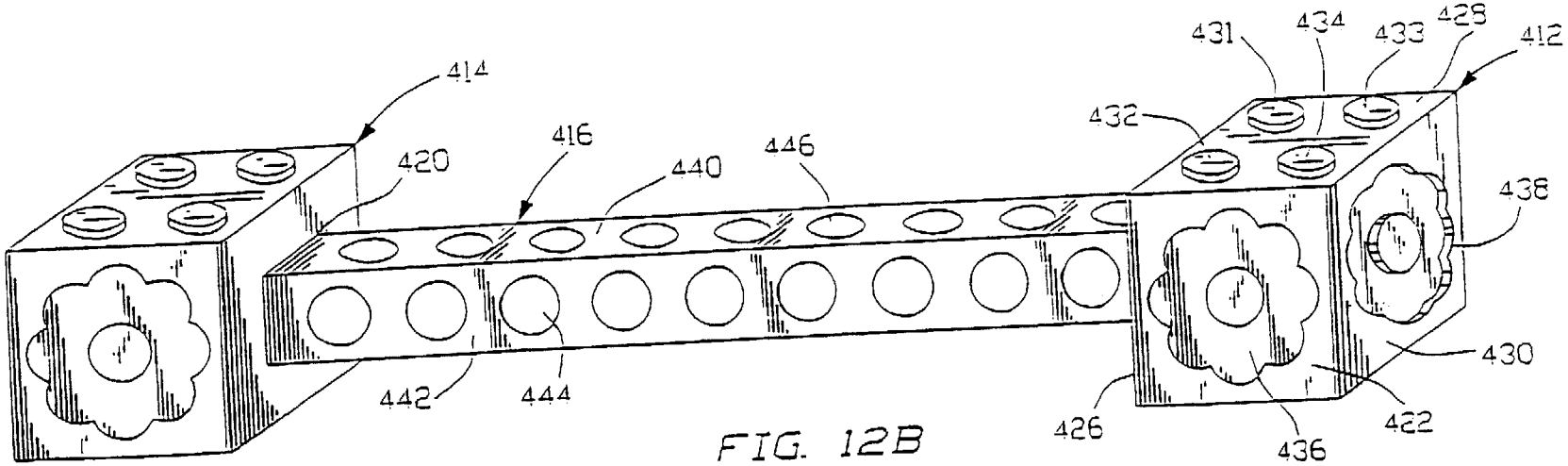
FIG. 12*b* shows a three-dimensional schematic of the construction beam-interlocking block body of FIG. 12*a;*
Figure 12C:
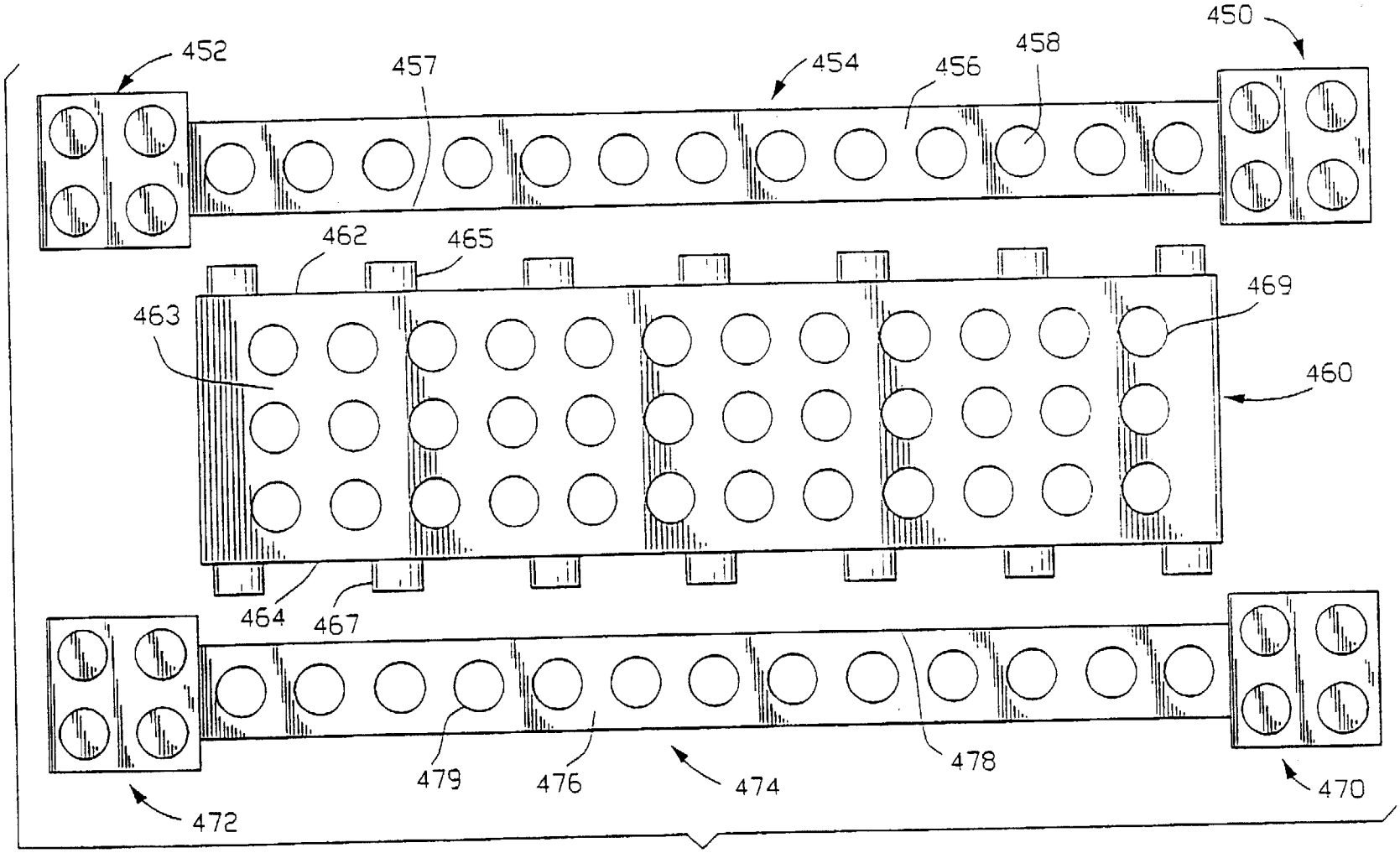
FIG. 12*c* shows a top view of a composite structure comprised of the construction beam-interlocking block body of FIGS. 12*a* and 12*b*, with a connection element.

FIG. **12*c* demonstrates this feature, whereby a top view of two construction beam-interlocking block bodies 450, 452, 454 and 470, 472, 474, like that 410 of FIG. 12*a* and 12*b*, is shown with a construction beam platform 460. The construction beam platform 460 is constructed such that each side 462, 464 of the platform 460 is comprised of a plurality of circular protrusions 465, 467 for mating with the connector means (not shown) in the side surfaces 457, 478 of the construction beam elements. The top surface 463 of the platform 460 is also comprised of protrusions 469, which can be arranged in any desired manner, to allow for any of the elements described herein, including the prior art block bodies, to interconnect thereto. Additionally, the platform 460 could be rotated 90 degrees to connect to the top surface 456 or 476 at the connector means 458, 479 of either of the construction beam 454, 474** members.

Figure 13:
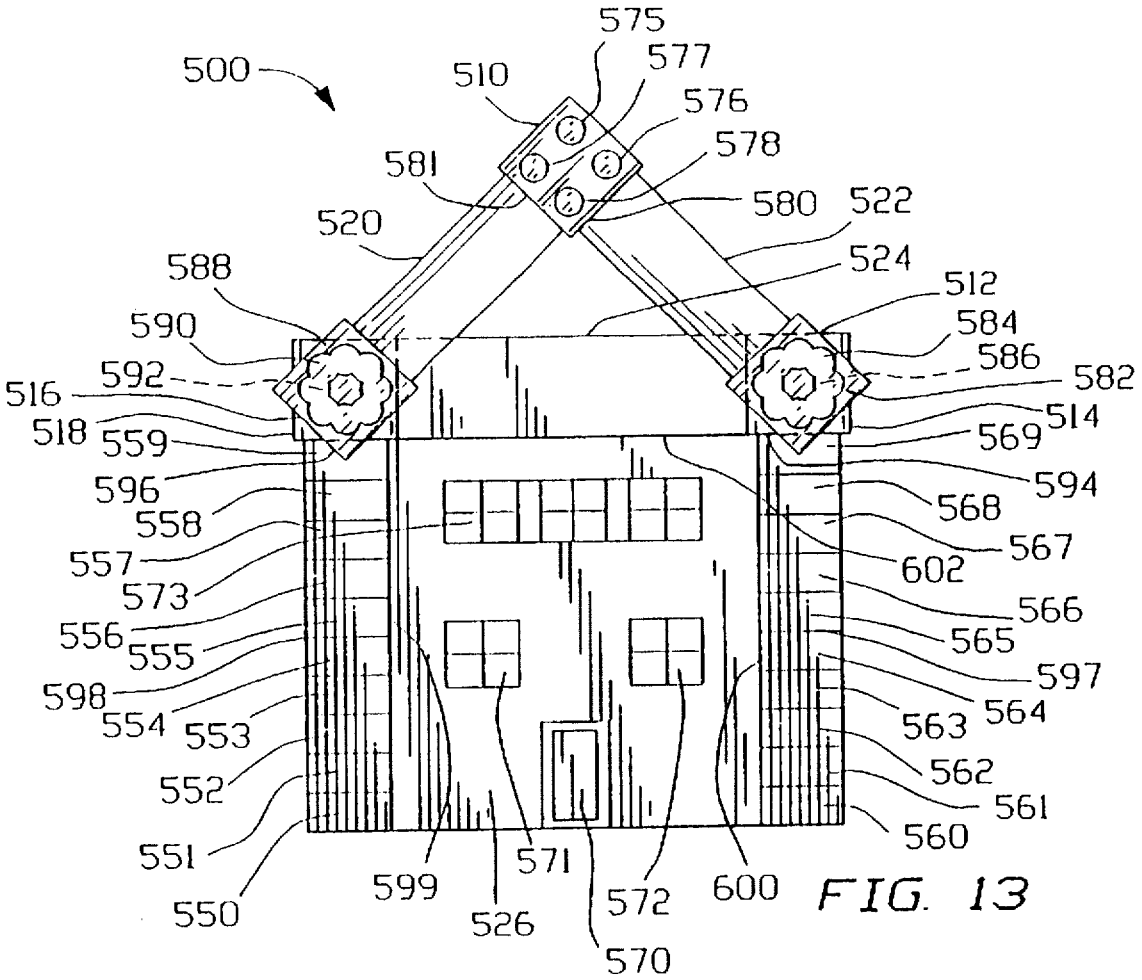
FIG.13 shows a plan view of a composite structure built with construction beam-interlocking block toy members, connection elements of the present invention and prior art block bodies.

FIG. 13 shows a toy house 500 made with the construction beams and interlocking blocks of the present invention and prior art. The front of the house is comprised of a plate 526 having any type of design of built in windows 571, 572 and 573 and doors, or door 570. On one end of the plate 602 are protruding connectors (not shown) for interlocking with the construction beam 524. Each side of the plate 599 and 600 is lined with stacked block bodies 550–559 (along side 599) and 560–569 (along side 600) that interconnect 597, 598 with each other, and to the block bodies 518 at 596 and 514 at 594, in a manner similar to that described in FIG. **6*c*. The roof portion is comprised of three construction beam-interlocking block body members. The first member has two block bodies 518 and 514 which are connected to construction beam element 524. The second member is similar, comprising two block bodies 510 and 512 and construction beam element 522. The third member differs in that it is comprised of only one block body 516 and one construction beam element 520. The three members are related through various connectors and connection means as described above, such that the first member and the second member are connected 586 at block bodies 514 and 512; while members two and three are connected 581 at block body 510 of member two and construction beam 520 of member three. Members one and three are connected 592 at their respective block bodies 516 and 518. In addition, the various facets of each member is provided with connectors. As show, facet 584 of block body 512 has an octa-arc connector 582, as does facet 588 of block body 516 (octa-arc connector 590). Facet 580 of block body 510 is also comprised of connectors 575, 576, 577, 578** arranged in a predetermined pattern.

Thus, it is seen that one advantage of the device of the present invention is that it allows for L-connections, end to end connections, side to side connections, and angled connections between not only block bodies and connection, but also between two construction beams. In addition to the arrangement of the various connector means on the block body, each connector may be either of a recessed or protruding type. This variation in arrangement and type helps in the building of a composite structure since the block body can be used as a means of re-aligning additional construction beams at differing angles.

The block bodies and construction beams of the present invention may come in a variety of colors, shapes and sizes. Some of the many variations are shown in FIGS. **14*a*–17**.

FIGS. **14*a*–14*c* show a side view, end view and top view, respectively, of a rectangular block body 700. As can be seen from FIG. 14*a*, the side facet 710 of the block has two octa-arc connectors 712, 714; while the top facet 708 has a plurality of protruding additional connectors 716, 717, 718, 719, 720, 721, 722, 723 located thereon. The end facet 706 of the block body 700 is comprised of a recessed connector means 725 adapted to receive mating protrusions on connection elements. As described in FIGS. 6*d*–6*h*, these connector means could be of a variety of shapes, be located on either side panel 710, 711, within either octa-arc connector 712, 714, or along the second end facet 702. Facet 704, indicated but not shown, may be configured like facet 708, facet 710 or a combination of facets 706 and 710**.

Figure 15A:
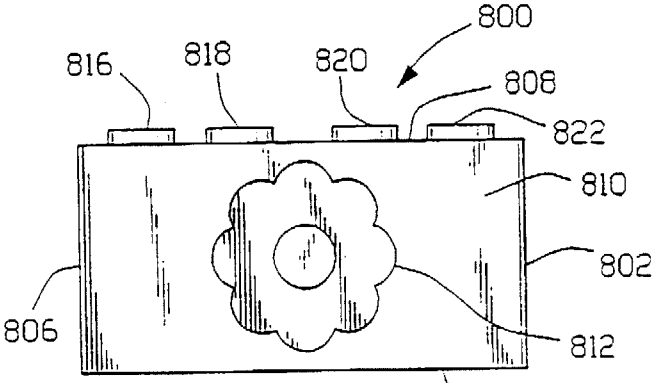
FIG. 15*a* shows a side view of a rectangular block body having one octa-arc connector.
Figure 15B:
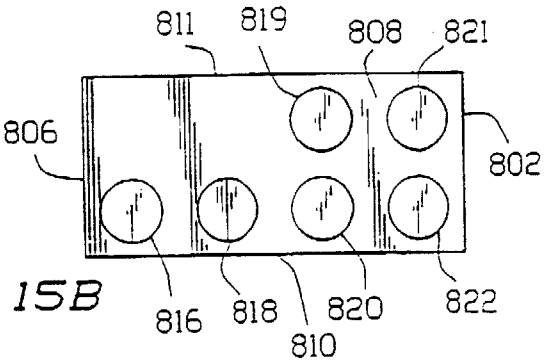
FIG. 15*b* shows a top view of the block body of FIG. 15*a;*
Figure 14B:
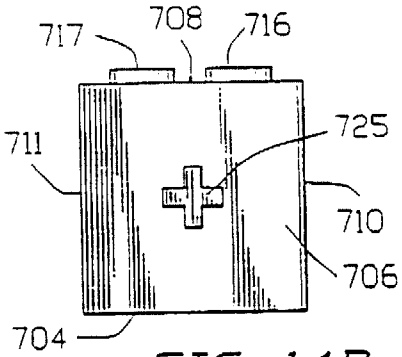
FIG. 14*b* shows an end view of the block body of FIG. 14*a;*
Figure 14A:
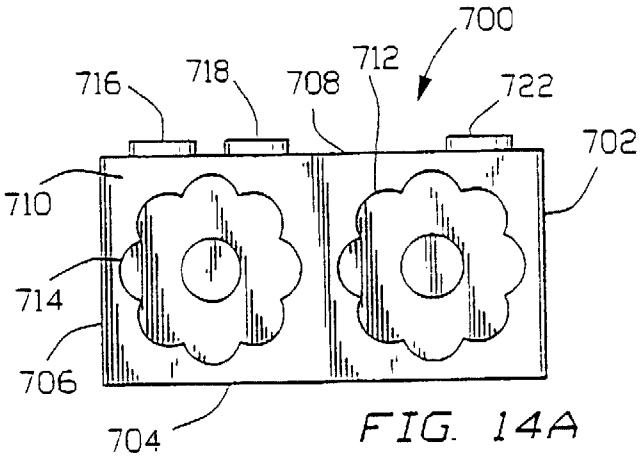
FIG. 14*a* shows a side view of a rectangular block body having two octa-arc connectors.
Figure 14C:
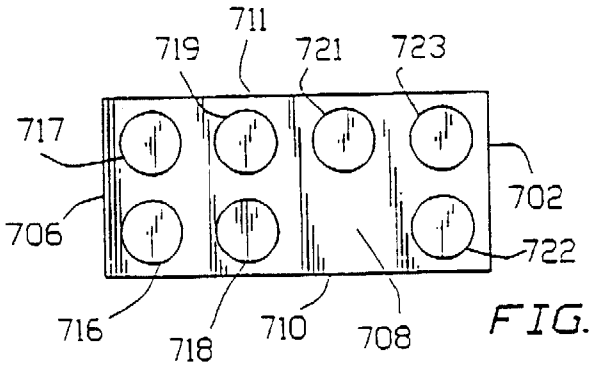
FIG. 14*c* shows a top view of the block body of FIG. 14*a;*

FIGS. 15*a* and 15*b* show side and top views of a rectangular block body 800 having a facet 810 with only one octa-arc connector 812. The top facet 808 comprises a plurality of protruding connectors 816, 818, 819, 820, 821, 822 arranged in a predetermined pattern as shown in FIG. 15*b*. The remaining facets 802, 804, 806, 811 could optionally have octa-arc connectors or other connectors as described above. The bottom facet 804 could comprise the hollow connector as described in FIG. 6*c*.

Even further variations of the octa-arc connector are described in FIGS. 16*a* and 17. FIG. 16*a* shows a cylindrical block body 900 having a top facet 902, bottom facet 904, and body portion 906. Recessed along the body portion 906 are means for interconnecting 908 to various block bodies of the prior art. In this case, the interconnecting means 908 are a plurality of protrusions 910, 911, 912, 913.

FIG. 16*b* shows the top facet 902*b* of the cylindrical body of FIG. 16*a* with both a plurality of recessed circular connecting means 915, 916, 917, 918 and a recessed cross-shaped connector 916. Alternatively, the top facet 902*d* of block body 900 could comprise an octa-arc connector 925 having an octagonally recessed connector 930 within an inner circular perimeter 927 of the octa-arc connector 925 as shown in FIG. 16*d*.

FIG. 16*c* shows a bottom facet 904*c* of the block body 900 with a hollow connector 920 as described above.

FIG. 17 shows an octagonal shaped octa-arc connector 950 having 10 facets, 952, 954, 956, 958, 960, 962, 964, 966, 968 and 970. At least one of the side facets 956 has means for interconnecting 974, with the top facet 968 having an octa-arc connector 972 thereupon.

Obviously, numerous modifications and variations of the present invention are possible in light of the above teachings. It is therefore understood that within the scope of the appended claims, the invention may be practiced otherwise than as specifically described herein.

What is claimed is:

1. A selective angular interlocking block toy comprising:

a. a block body having a plurality of facets;

b. an octa-arc connector on at least one of said plurality of facets, said octa arc connector having a recessed surface area circumscribed by an outer perimeter of arcs of eight symmetrically arranged, overlapping circles configured in a generally circular orientation, said recessed surface area being connectable to at least one other block body having at least one facet configured with a plurality of protrusions in a predetermined pattern for being inserted against said recessed surface area and being pinched by said outer perimeter of arcs.

2. The selective angular interlocking block toy of claim 1, further comprising connection means to at least one construction beam, said connection means being on a second at least one of said plurality of facets.

3. The selective angular interlocking block toy of claim 1, further comprising connection means to at least one construction beam connected to another block body, said connection means being on a second at least one of said plurality of facets.

4. The selective angular interlocking block toy of claim 1, wherein said plurality of facets is at least five facets.

5. The selective angular interlocking block toy of claim 4, wherein at least one of said at least five facets comprises additional connector means.

6. The selective angular interlocking block toy of claim 5, wherein said additional connector means is a group of circular protrusions arranged in a predetermined pattern.

7. The selective angular interlocking block toy of claim 5, wherein said additional connector means is a group of circular recesses arranged in a predetermined pattern.

8. The selective angular interlocking block toy of claim 1, wherein said plurality of facets are a top surface, a bottom surface and an outer surface circumscribed by said top and bottom surfaces, said outer surface having a cross section whose shape is selected from the group consisting of a rectangle, square, octagon and circle.

9. The selective angular interlocking block toy of claim 8, wherein said octa-arc connector is on at least one of said top and bottom surfaces.

10. A selective angular interlocking block toy comprising:

a. a block body having a plurality of facets;

b. an octa-arc connector on at least one of said plurality of facets, said octa-arc connector having a recessed surface area circumscribed by an outer perimeter of arcs of eight symmetrically arranged, overlapping circles configured in a generally circular orientation, said recessed surface area being connectable to at least one other block body having a facet configured with a plurality of protrusions in a predetermined pattern for being inserted against said recessed surface area and being pinched by said outer perimeter of arcs; and, c. a construction beam having first and second end portions and first and second side portions, at least one of said first and second end portions being connected to a second at least one of said plurality of facets.

11. The selective angular interlocking block toy of claim 10, wherein said at least one of said first end and second end portions is permanently connected to said second at least one of said plurality of facets to form a composite structure.

12. The selective angular interlocking block toy of claim 10, wherein said at least one of said first end and second end portions is removably connected to said second at least one of said plurality of facets.

13. The selective angular interlocking block toy of claim 12, wherein said at least one of said first end and second end portions is configured with protruding connection means and said second at least one of said plurality of facets is provided with mating recessed connection means for removably connecting said protruding connection means and said recessed connection means.

14. The selective angular interlocking block toy of claim 13, wherein said protruding connection means has a cross sectional shape selected from the group consisting of a cross, an octagon and a circle.

15. The selective angular interlocking block toy of claim 10, wherein at least one of said first and second side portions further comprise a plurality of cut-outs, said plurality of cut-outs being voids providing snap-in connection by mating with another construction beam having another first and second side portions, said another construction beam having a plurality of protrusions on at least one of said another first and second side portions configured similarly to said plurality of cut-outs, at least one of said plurality of protrusions being insertable into at least one of said plurality of cut-outs and pinched by perimeter of said at least one of said plurality of cut-outs.

16. A selective angular interlocking block toy comprising:

a. a first block body having a first plurality of facets;

b. a second block body having a second plurality of facets;

c. an octa-arc connector on at least one of said first plurality of facets and said second plurality of facets each, said octa-arc connector having a recessed surface area circumscribed by an outer perimeter of arcs of eight symmetrically arranged, overlapping circles configured in a generally circular orientation, said recessed surface area being connectable to at least one other block body having a facet configured with a plurality of protrusions in a predetermined pattern for being inserted against said recessed surface area and being pinched by said outer perimeter of arcs; and, c. a construction beam having first and second end portions and first and second side portions, said first end portion being connected to at least one of said first plurality of facets and said second end portion being connected to at least one of said second plurality of facets.

17. The selective angular interlock block toy of claim 16, wherein said first plurality of facets and said second plurality of facets each is at least five facets.

18. The selective angular interlock block toy of claim 17, wherein at least one of said at least five facets comprises additional connector means.

19. The selective angular interlocking block toy of claim 18, wherein said additional connector means is a group of circular protrusions arranged in a predetermined pattern.

20. The selective angular interlocking block toy of claim 18, wherein said additional connector means is a group of circular recesses arranged in a predetermined pattern.

21. The selective angular interlocking block toy of claim 16, wherein said first plurality of facets and said second plurality of facets each are a top surface, a bottom surface and an outer surface circumscribed by said top and bottom surfaces, said outer surface having a cross section whose shape is selected from the group consisting of a rectangle, square, octagon, and circle.

22. The selective angular interlocking block toy of claim 21, wherein said octa-arc connector is on at least one of said top and bottom surfaces.

* * * * *